US005462480A

United States Patent [19]

Suzukawa

[11] Patent Number: 5,462,480

[45] Date of Patent: Oct. 31, 1995

[54] COIN DISPENSING APPARATUS

[75] Inventor: Yorio Suzukawa, Saitama, Japan

[73] Assignee: Asahi Seiko Kabushiki Kaisha, Tokyo, Japan

[21] Appl. No.: 191,101

[22] Filed: Feb. 3, 1994

[30] Foreign Application Priority Data

Feb. 5, 1993 [JP] Japan ..... 5-011925 U

[51] Int. Cl.[6] ..... G07D 1/00

[52] U.S. Cl. ..... 453/49; 453/57

[58] Field of Search ..... 453/18, 49, 57, 453/63

[56] References Cited

U.S. PATENT DOCUMENTS

| | | | |
|---|---|---|---|
| 4,476,884 | 10/1984 | Gonzalez | 453/57 |
| 4,752,274 | 6/1988 | Abe | 453/57 X |
| 4,997,406 | 3/1991 | Horiguchi et al. | 453/57 |
| 5,066,262 | 11/1991 | Abe . | |
| 5,114,381 | 5/1992 | Ueda et al. | 453/57 |
| 5,170,874 | 12/1992 | Abe . | |
| 5,282,769 | 2/1994 | Suzukawa | 453/49 |
| 5,306,206 | 4/1994 | Abe | 453/57 X |

FOREIGN PATENT DOCUMENTS

| | | | |
|---|---|---|---|
| 204405 | 12/1986 | European Pat. Off. . | |
| 0345868 | 12/1989 | European Pat. Off. | 453/57 |
| 61-281385 | 12/1986 | Japan . | |
| 5094575 | 4/1993 | Japan | 453/57 |
| 2073126 | 10/1981 | United Kingdom . | |
| 2208738 | 4/1989 | United Kingdom . | |

*Primary Examiner*—Michael S. Huppert
*Assistant Examiner*—Scott L. Lowe
*Attorney, Agent, or Firm*—Sughrue, Mion, Zinn, Macpeak & Seas

[57] ABSTRACT

A coin dispensing apparatus which quickly and reliably collects coins remaining in an escalator 17 has a coin transporting disc 4 which can be rotated in reverse by a motor 5. Coin guide apertures 8 in the disc guide coins A onto a substrate 2. A coin transporting arm 9 is located between the substrate 2 and the disc 4, and rotates in forward and reverse together with the disc. A coin dropping onto the substrate 2 through an aperture 8 slides along a path of rotation on the substrate. During reverse rotation the transporting arm 9 dispenses a coin towards collection outlet 40. Reciprocating guide member 50 is located between the substrate 2 and the disc 4, and is provided between outlet slot 10 and collection outlet 40. This reciprocating guide member 50 makes contact with a dispensed coin to guide it to the collection outlet.

7 Claims, 5 Drawing Sheets

COIN DISPENSING APPARATUS

BACKGROUND OF THE INVENTION

This invention relates to a coin dispensing apparatus equipped with an escalator and what is generally referred to as a coin transporting duct, and more particularly, to a coin dispensing apparatus which removes coins, medals and tokens used in, for example, money changers, gaming machines and the like, remaining in the escalator, as well as coins remaining in apparatus components.

A coin dispensing apparatus of this type is disclosed in Japanese Kokai No. 61-281385 filed by the present applicant. As shown in FIGS. 3 and 4, the apparatus comprises a cylindrical case 3 provided on the bottom end of a hopper 1 which defines a containment space containing a plurality of coins. An outlet slot 10 is formed by providing an opening in the bottom end of the peripheral wall at the top of the case 3. As seen in FIG. 3, an inclined substrate 2 forms the bottom of case 3 and a coin transporting disc 4 is arranged on the substrate and driven to rotate in a forward direction (counter-clockwise) by the shaft 7 of motor 5. Formed within the disc 4 are five coin guide apertures 8, each of which is sized with a diameter sufficient to receive a coin face-wise and permit it to pass through the disc 4. As a result, coins in the hopper 1 will fall into the apertures 8 and will lie against the substrate 2. Extending along a part of the circumference of each aperture, and disposed for transportingly supporting a coin which has fallen into the aperture, are coin transporting arms 9. As seen from the cross section of the disc in FIG. 3 and the hatched portion of FIG. 4, the arm 9 is a solid structure that forms a wall surface of the aperture for support of the coins in the aperture, particularly when they are at the upper rotary location of the disc. The arms 9 extend between the substrate 2 and the coin transporting disc 4 and define a broken circle having a radius that passes through the center of each aperture 8. As the arms 9 rotate with the disc 4, they cause coins dropped into apertures 8 to be guided slidingly against substrate 2 and along a prescribed path of rotation on the substrate. This path leads to a location for dispensing the coins in the direction of outlet slot 10. At slot 10 is an outlet guide pin 30 which makes contact with coins dispensed by the arm 9 to remove the coins from the path of rotation and guide them to the outlet slot and an outlet guide member 11 arranged on the downstream side of outlet slot 10 between substrate 2 and disc 4, which guides coins A removed from the path of rotation by the pin 30 to the outlet slot.

In addition, a scraper 13 is provided having the same number (5) of radial transporting blades 12 as the number of coin guide apertures 8 of the disc 4. Scraper 13 is rotated clockwise on substrate 2 in synchronization with the disc 4 by reduction gears 6. The transporting blades 12 engage coins in apertures 8 when they pass through slot 10*a* at the interface between the substrate 2 and the disc 4. The blades 12 dispense coins by scraping them to the outside of slot 10, along path 15 and against the guide 21.

As seen in FIG. 3, an escalator 17 is fixed vertically above substrate 2, and works together with pairs of left and right guide rollers 19 forming a row and transporting blades 12 to push ahead coins towards a bottom entrance 16 of the escalator.

The left and right guide rollers 19 have downward facing tapered surfaces, as shown in FIG. 3. Transporting blades 12 of scraper 13 work together with outlet guide member 11 to sequentially push coins scraped from outlet slot 10 between the left and right guide rollers 19. At this time, coins proceed towards the bottom entrance 16 of the escalator 17 while being prevented from lifting up by the downward facing tapered surfaces of the guide rollers.

Coins dispensed by the rotation of coin transporting disc 4 driven by the motor 5 are guided to rollers 19 by scraper 13 where they are pushed into escalator 17 and ascent in a row by being pushed from below by following coins.

Japanese Kokai No. 4-220790 discloses another coin dispensing apparatus equipped with an escalator filed by the present applicant. As shown in FIG. 5, this type of coin dispensing apparatus has a reversible rotation rotary disc 4 in opposition to a substrate, a central disc 41 arranged in the center of disc 4, dispensing pins 42 arranged around the circumference of disc 4 which receive coins between themselves and the outside edge of central disc 4 and dispense the coins along a path of rotation, and an outlet guide knife 43 arranged on one side of central disc 41. Outlet guide knife 43, the rear end of which is fixed on the outlet side of a substrate and the front end of which extends to the outside edge of central disc 41, guides coins dispensed along the path of rotation to an outlet when the disc 4 rotates.

However, in the coin dispensing apparatus of the prior art described above, when coins remain in the escalator following the completion of a coin dispensing operation, since the motor only rotates in a fixed direction, namely a counter-clockwise direction, it is not possible to collect those coins. Thus, one has to remove the escalator body or its cover plate each time it is desired to collect remaining coins in order to eliminate the above disadvantage. Moreover, in the case of performing this removal, additional trouble can result since the removed component has to be reattached after collection of the coins.

On the other hand, in the case of discharging to the outside or collecting coins remaining in the bottom of the hopper or coins remaining as a result of being guided to the substrate from the coin guide apertures, there is a similar disadvantage of having to disassemble apparatus components.

SUMMARY OF THE INVENTION

Therefore, in consideration of the above disadvantages, a first technical object of the invention is to provide a coin dispensing apparatus which quickly and reliably collects coins remaining in the escalator.

In addition, a second technical object of the invention is to provide a coin dispensing apparatus which quickly and reliably discharges to the outside or collects coins remaining in the bottom of the hopper and coins remaining as a result of being guided to the substrate from the coin guide apertures.

According to the invention, a coin dispensing apparatus comprises a substrate containing a first location at which an outlet is arranged and a second location differing from the first position, and a dispensing mechanism arranged to freely rotate reversibly with respect to said substrate which dispenses coins towards the outlet during forward rotation. The dispensing mechanism dispenses coins returned from the outlet to the second location during reverse rotation.

In addition, according to the invention, the substrate has an escalator which carries out coins dispensed through the outlet in a prescribed direction. The substrate has a collection outlet at the second location which collects coins that have been returned via the outlet from the escalator.

According to the invention, the dispensing mechanism has a reversible rotation rotary disc opposed to the substrate at a clearance essentially corresponding to the thickness of the coins, guide apertures opened in the rotary disc which guide coins over the substrate, a dispensing arm arranged between the substrate and the rotary disc which dispenses coins along a prescribed path of rotation on the substrate corresponding to the rotation of the rotary disc, and an outlet guide member arranged between the substrate and the rotary disc which makes contact with coins dispensed from the dispensing arm in the case of forward rotation by the rotary disc and guides the coins from the path of rotation to said outlet. The dispensing arm reverse rotates corresponding to reverse rotation of the rotary disc, receives coins returned from the escalator via the outlet, and dispenses the coins towards the collection outlet along the path of rotation.

In addition, according to the present invention, a coin dispensing apparatus is obtained wherein said coin dispensing apparatus has a collection outlet guide member arranged between said substrate and said rotary disc which makes contact with coins dispensed from said dispensing arm by its reverse rotation and guides said coins from said path of rotation to said collection outlet.

In addition, according to the present invention, a coin dispensing apparatus is obtained wherein said collection outlet guide member has a contact surface which makes contact with coins dispensed from said dispensing arm, and said contact surface is arranged transverse to said path of rotation.

In addition, according to the present invention, a coin dispensing apparatus is obtained wherein said outlet guide member and said collection outlet guide member are provided integrated into a single unit on different sides as reciprocating rotating members.

In addition, according to the present invention, a coin dispensing apparatus is obtained wherein said dispensing mechanism has a reversible rotation rotary disc opposed to said substrate, a central disc arranged in the center of said substrate, dispensing pins arranged on the circumference of said rotary disc which receive coins between themselves and the outer edge of said central disc and dispense said coins along said path of rotation, and an outlet guide knife and collection outlet guide knife arranged mutually in opposition on both sides of said central disc; wherein, said outlet guide knife, one end of which is fixed on the outlet side of said substrate and the other end of which extends to the outside edge of said central disc, guides coins dispensed along said path of rotation to said outlet in the case of forward rotation by said rotary disc., and said collection outlet guide knife, one end of which is fixed on the collection outlet side of said substrate and the other end of which extends to the outside edge of said central disc, guides coins dispensed along said path of rotation to said collection outlet in the case of reverse rotation by said rotary disc.

In addition, according to the present invention, a coin dispensing apparatus is obtained wherein said outlet guide knife and collection outlet guide knife are provided retractably with respect to said central disc, said outlet guide knife moves away from said central disc by a distance essentially corresponding to at least the thickness of coins in the case of reverse rotation by said rotary disc, and said collector outlet guide knife moves away from said central disc by a distance essentially corresponding to at least the thickness of coins in the case of forward rotation by said rotary disc.

Remaining coins in an escalator can be collected by reverse rotation of a reversible rotation rotary disc, the receiving of coins from the escalator via an outlet guide member by a dispensing arm, and the dispensing of said coins to a second location below a substrate.

In addition, coins dispensed by the dispensing arm make contact with a collection outlet guide member by which said coins are guided to a collection outlet provided at said second location where said coins are either discharged to the outside or collected.

DETAILED DESCRIPTION OF THE PREFERRED EMBODIMENTS

Figure 1:
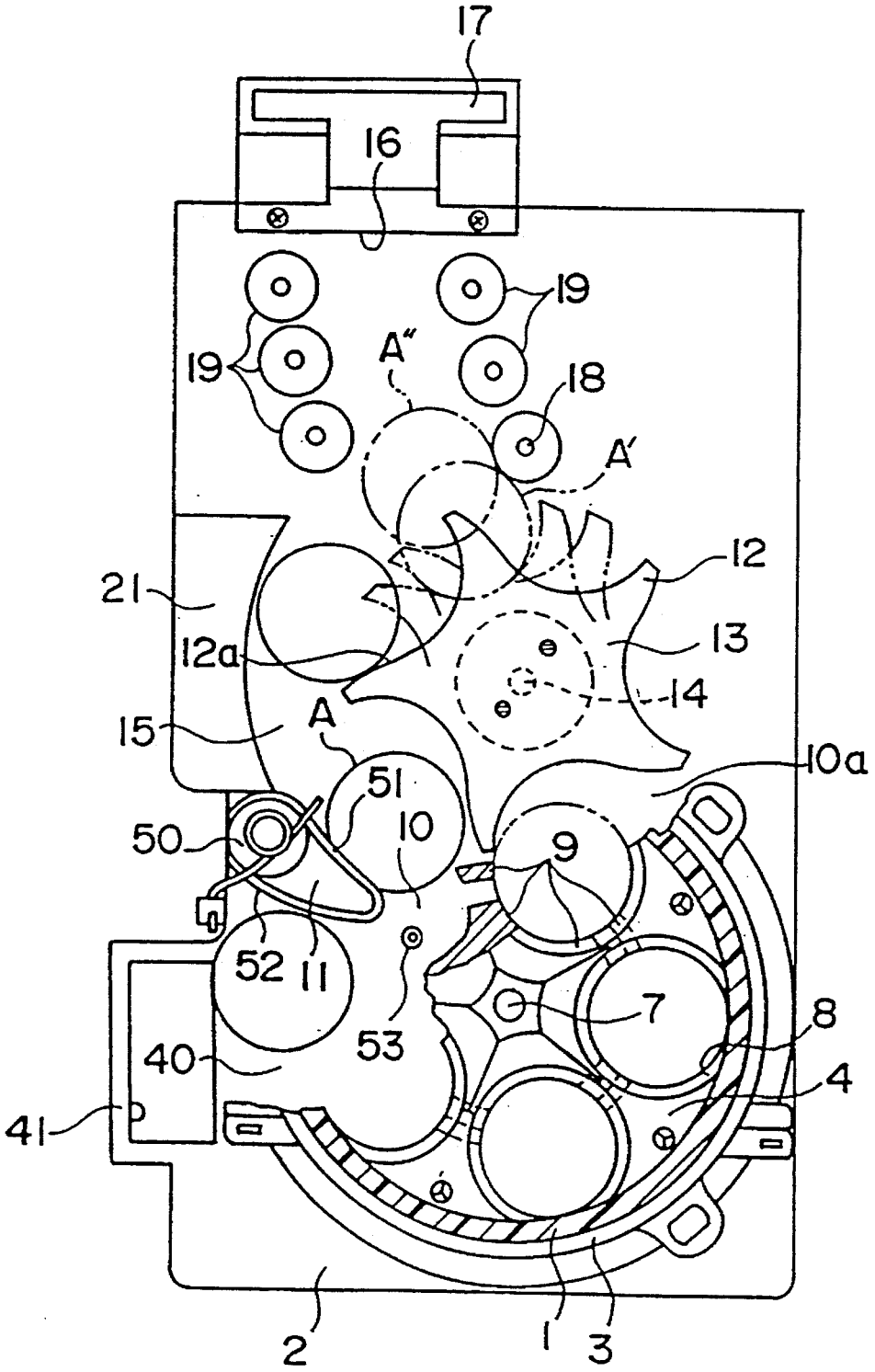
FIG. 1 is a cross-sectional view of a coin dispensing apparatus equipped with an escalator according to an embodiment of the present invention.

As shown in FIG. 1, in the coin dispensing apparatus of a first embodiment of the present invention, scraper 13 is provided on the upper half of inclined substrate 2, and escalator 17 is provided vertically on its upper end. In addition, the lower half of inclined substrate 2 is enclosed by cylindrical case 3. Outlet slot 10 is opened in the upper left side of the cylindrical case corresponding to a first location, while collection outlet slot 40 is provided in the lower left side of cylindrical case 3 corresponding to a second location. The first and second locations are divided by guide pin 53 and guide member 50, as later described in detail.

Transporting blades 12 of scraper 13 rotate clockwise to sequentially push coin A scraped from outlet 10 between pairs of left and right guide rollers 19. At this time, the coins proceed towards bottom entrance 16 of escalator 17 while downward facing tapered surfaces of guide rollers 19 prevent the coins from lifting.

On the other hand, coin transporting disc 4 is connected to motor shaft 7 of reversible rotation motor 5 allowing both forward and reverse rotation. Furthermore, switching between forward and reverse rotation of motor 5 is performed either automatically or manually by a rotation direction changing switch (not shown). Five coin guide apertures 8 are formed in coin transporting disc 4 and are shaped to cause coins A to drop through onto substrate 2. Coin transporting arms 9 are located between substrate 2 and coin transporting disc 4 and form support structures for the sides of the coins as the coins are carried against the surface of substrate 2. The arms 9 are formed by a structure that extends in a radial direction from the center of rotation 7 to a location approximately at the centers of coin guide apertures 8. The coin transporting arms 9 are connected to coin transporting disc 4, and slides coin A as it lies along the surface of substrate 2 after dropping through coin guide apertures 8.

In the case of forward rotation by coin transporting disc 4, coin transporting arm 9 supports the bottom of coins A as they are moved counterclockwise towards outlet slot 10. In the case of reverse rotation by coin transporting disc 4, coin transporting arm 9 supports the bottom of the coins as they rotate clockwise until the force of gravity causes the coins to rest along the inner surface of the cylinder 3 and complete their travel towards collection outlet 40.

In the present embodiment, reciprocating guide member 50 is provided at a location between substrate 2 and coin transporting disc 4, and between outlet slot 10 and collection outlet 40. Reciprocating guide member 50 has outlet guide surface 51 on its outlet slot side and collection outlet guide surface 52 on its collection outlet side. Outlet guide surface 51 and collection outlet guide surface 52 are tapered to realize smooth dispensing of coins.

In addition, reciprocating guide pin 53 is located between substrate 2 and coin transporting disc 4, and is provided near reciprocating guide member 50.

In the case of forward rotation by coin transporting disc 4, coin A is carried clockwise toward outlet slot 10 by coin transporting arm 9 and then makes contact with reciprocating guide pin 53 causing it to be removed from the path of rotation and be guided to outlet slot 10 as a result of making contact with outlet guide surface 51. 0n the other hand, in the case of reverse rotation by coin transporting disc 4, coin A is carried clockwise toward collection outlet 40 by coin transporting arm 9 and makes contact with reciprocating guide pin 53, causing it to be removed from the path of rotation and be guided to collection outlet 40 as a result of making contact with collection outlet guide surface 52. Coins guided to collection outlet 40 are collected after being discharged to collection chute 41 arranged nearby.

A notch 54, which joins adjacent apertures 8, is provided in coin transporting arms 9 so that the disc and associated arm structure freely passes over reciprocating guide pin 53.

Furthermore, reciprocating guide member 50 is provided retractably with respect to substrate 2 by a cantilever spring and so forth. In the case an overload is applied for whatever reason, reciprocating guide member 50 is of a structure that allows it to retract into substrate 2 to relieve the load. Similarly, reciprocating guide pin 53 is also provided retractably with respect to substrate 2, and is also of a structure that relieves excessive load.

The following provides an explanation of the case of collecting coins remaining in escalator 17 following completion of coin dispensing operation.

Firstly, the direction of rotation of motor 5 is switched by a rotation direction changing switch to reverse rotation (clockwise rotation). Coin transporting disc 4 rotates in reverse due to the reverse rotation of motor 5. Simultaneously, scraper 13 rotates in reverse over substrate 2 in synchronization with coin transporting disc 4 due to operation of speed reduction apparatus 6. As a result, coins remaining in escalator 17 return by their own weight from bottom entrance 16 of escalator 17 through pairs of left and right guide rollers 19 arranged in a row.

Coins are received from bottom entrance 16 of escalator 17 in coordination with the reverse rotation of transporting blades 12 of scraper 13. Coins are then carried by the clockwise rotation of apertures 8 towards collection outlet 40 by first resting against the arms 9, then against the side walls of cylinder 3, and finally again against the coin transporting arm 9. Upon reaching the reciprocating guide member 50 and reciprocating guide pin 53, the coins are diverted toward collection outlet 40.

At this point, when the coins are in contact between coin transporting arm 9 and collection outlet guide surface 52 of reciprocating guide member 50, they are then guided to collection outlet 40 by collection guide surface 52 in cooperation with reciprocating guide pin 53 where said coins are collected after being discharged to collection chute 41.

Furthermore, although the following has provided an explanation of coins remaining in escalator 17 in the present embodiment, coins remaining in hopper 1 are also sequentially guided to coin transporting arm 9 via coin guide apertures 8, after which said coins are guided to collection outlet 40 and collected after being discharged to collection chute 41.

Moreover, a counter (not shown) may be arranged at collection outlet 40 to count the number of remaining coins discharged.

Figure 2:
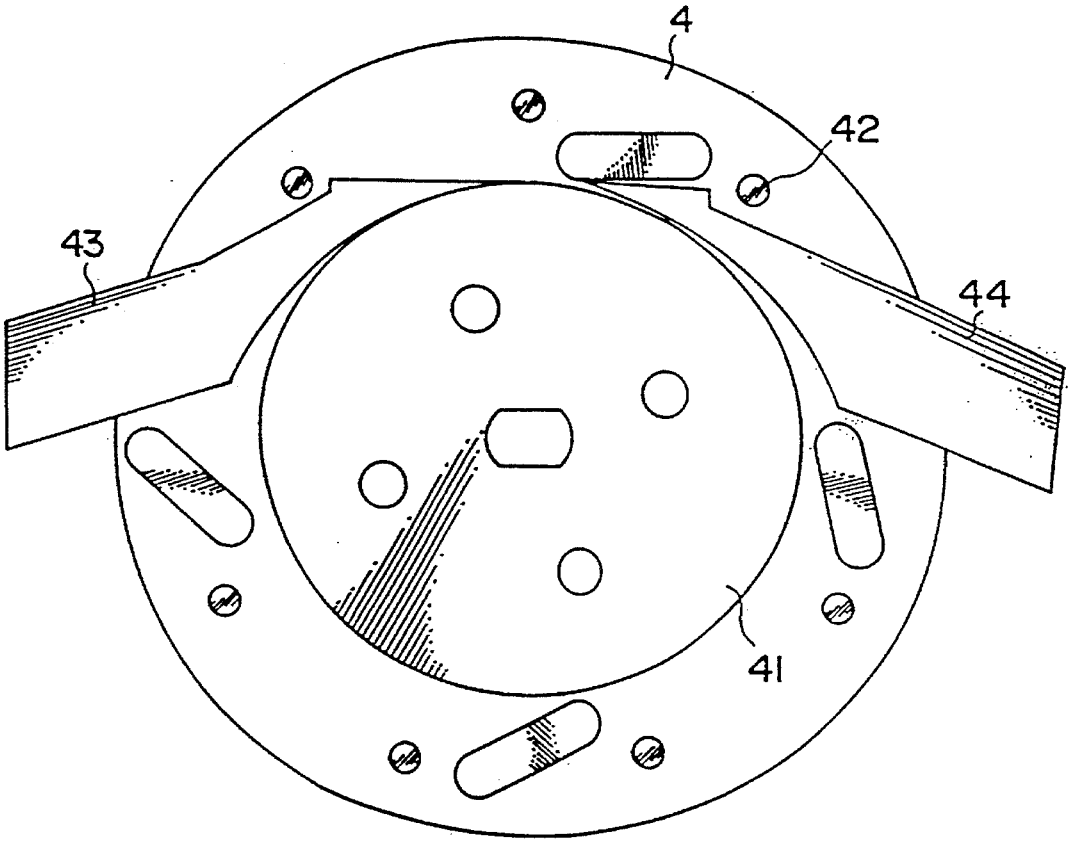
FIG. 2 is an overhead view of a coin dispensing apparatus of another embodiment of the invention.
Figure 3:
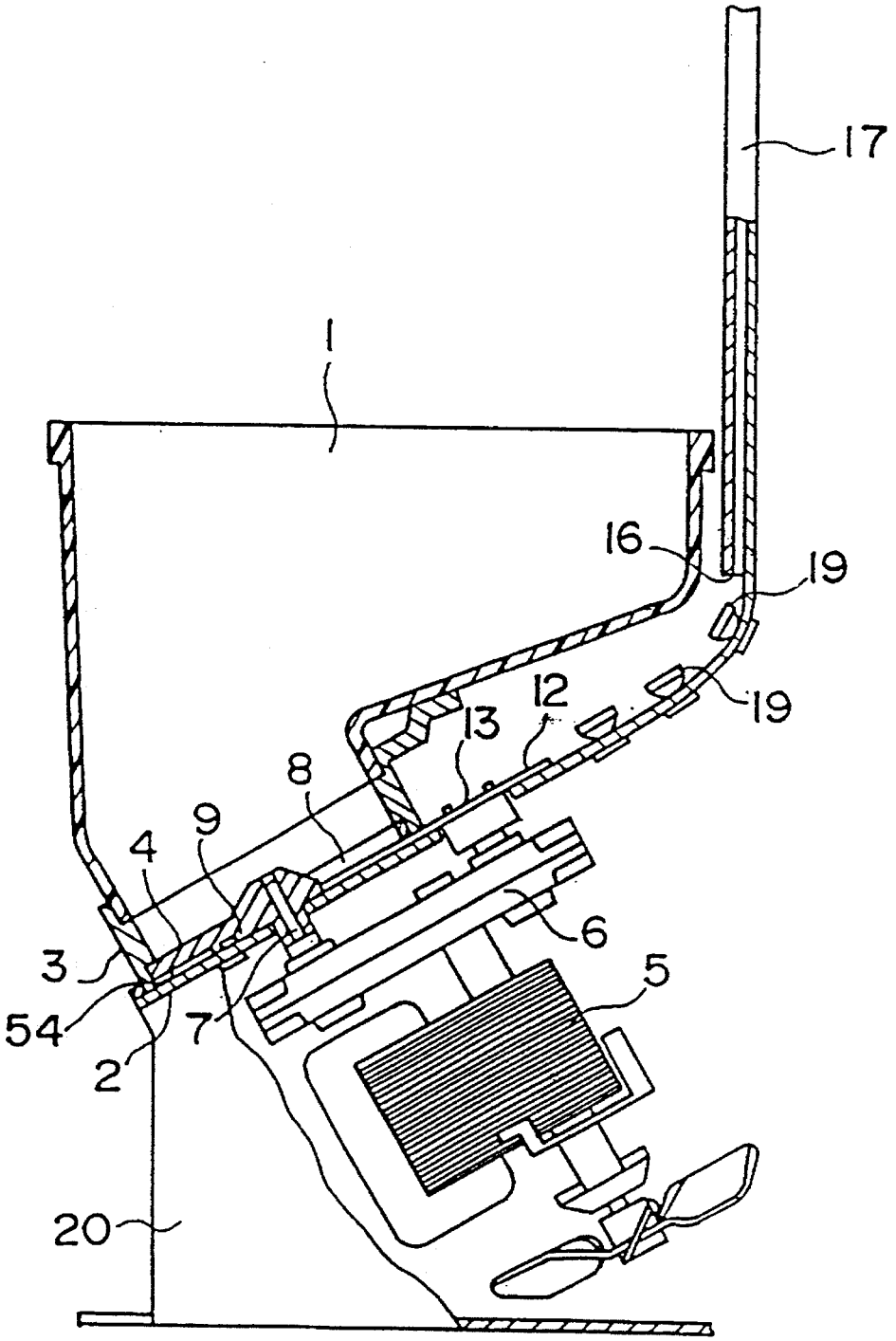
FIG. 3 PRIOR ART
FIG. 3 is a cross-sectional side view of a typical coin dispensing apparatus equipped with an escalator.
Figure 4:
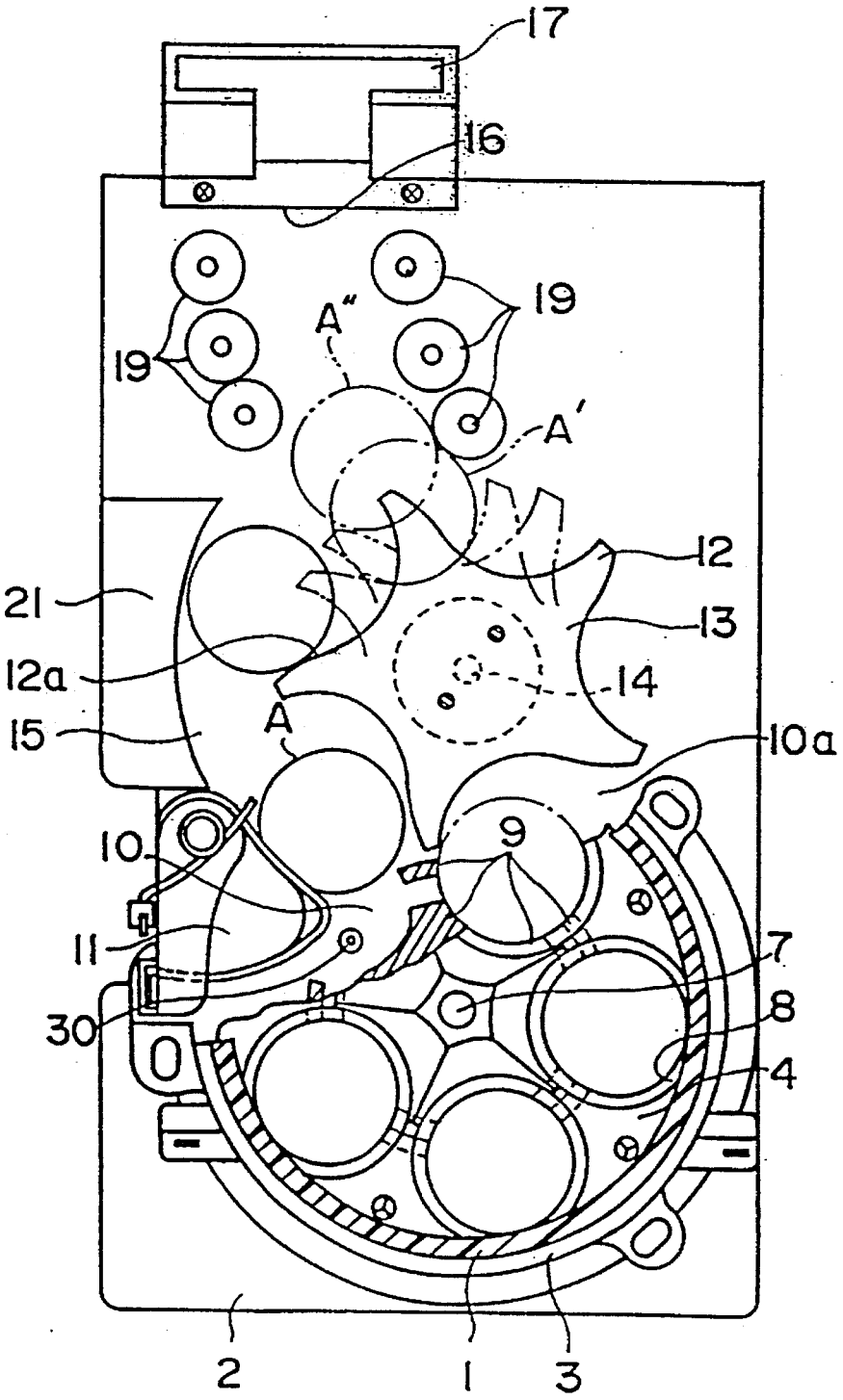
FIG. 4 PRIOR ART
FIG. 4 is a cross-sectional top view of the coin dispensing apparatus of FIG. 3.
Figure 5:
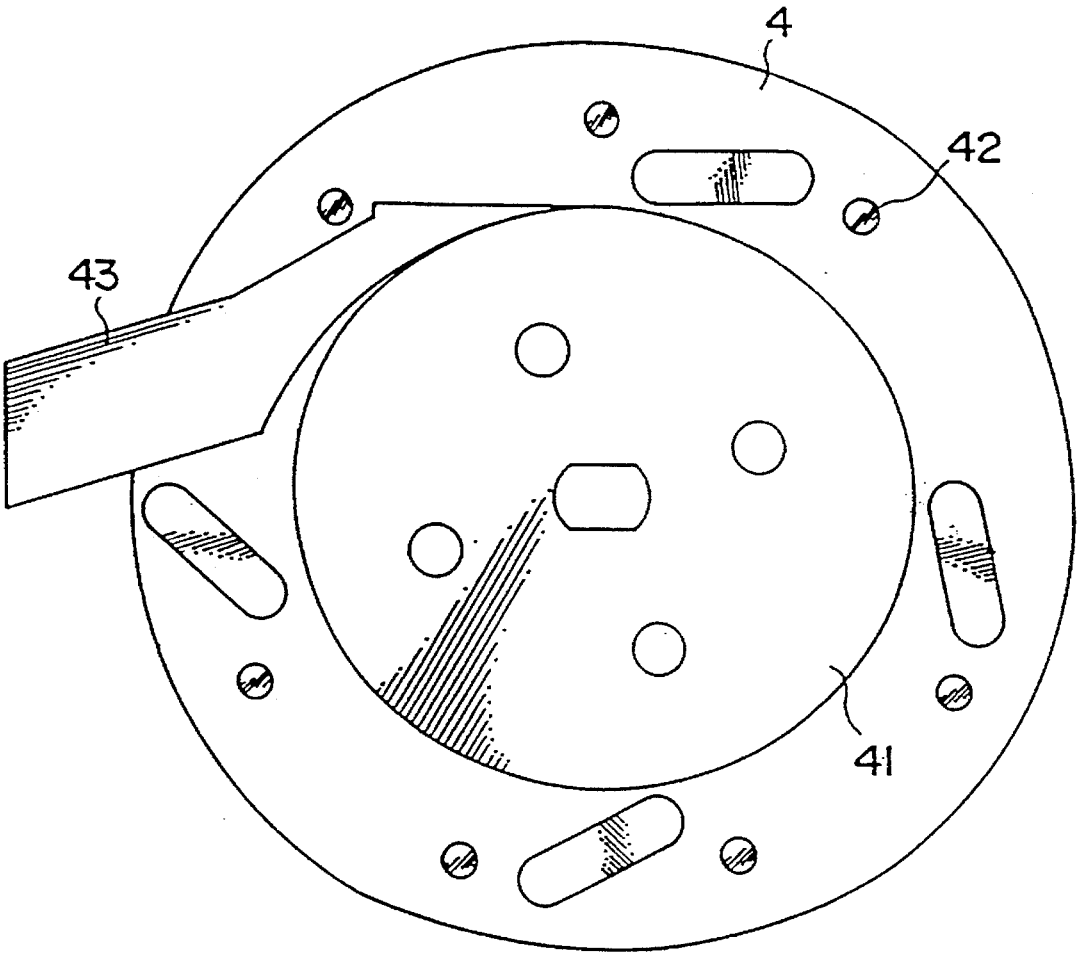
FIG. 5 PRIOR ART
FIG. 5 is a perspective view of another conventional coin dispensing apparatus.

The following provides an explanation of another embodiment of the present invention. Referring to FIG. 2, outlet guide knife 43 and collection outlet guide knife 44 are provided mutually in opposition on both sides of central disc 41. Collection guide knife 44, the rear end of which is fixed on the collection outlet side (left side in FIG. 2) of substrate 2 and the front end of which extends to the outside edge of central disc 41, guides coins dispensed along the path of rotation to a collection outlet (not shown) in the case of reverse rotation by rotary disc 4.

Outlet guide knife 43 and collection outlet guide knife 44 are provided retractably with respect to the central disc 41. Outlet guide knife 43 and collection outlet guide knife 44 are supported in cantilever fashion such that outlet guide knife 43 moves away from central disc 41 by a distance essentially corresponding to at least the thickness of the coins in the case of reverse rotation by rotary disc 4, while collection outlet guide knife 44 moves away from central disc 41 by a distance essentially corresponding to at least the thickness of the coins in the case of forward rotation by rotary disc 4.

According to the present invention as explained above, coins may be discharged to the outside as a result of a reversible rotation rotary disc. A transporting arm is operative to receive coins from an escalator via escalator guide members, and supportingly guide the coins to an outlet. Coins remaining in the escalator as well as coins remaining in the bottom of a hopper can be collected quickly and reliably by being discharged to the outside.

What is claimed is:

1. A coin dispensing apparatus comprising: a substrate containing a first location at which a delivery outlet is arranged and a second location differing from said first location; and, a dispensing mechanism arranged to freely rotate reversibly with respect to said substrate which dispenses coins towards said delivery outlet during forward rotation; wherein, said dispensing mechanism dispenses coins returned from said delivery outlet to said second location during reverse rotation and wherein said dispensing apparatus further comprises a coin guide member, disposed between said substrate and said rotating disc and continually extending into the rotational path of coins carried by said dispensing mechanism in both said forward and reverse rotation direction.

2. The coin dispensing apparatus as set forth in claim 1 wherein said substrate has an escalator which carries out coins dispensed through said delivery outlet in a prescribed direction.

3. The coin dispensing apparatus as set forth in claim 2 wherein said substrate has a collection outlet at said second location which collects coins that have been returned via said delivery outlet from said escalator.

4. A coin dispensing apparatus comprising: a substrate containing a first location at which a delivery outlet is arranged and a second location differing from said first location; and, a dispensing mechanism arranged to freely rotate reversibly with respect to said substrate which dispenses coins towards said delivery outlet during forward rotation;

wherein, said dispensing mechanism dispenses coins returned from said outlet to said second location during reverse rotation wherein said substrate has an escalator which caries out coins dispensed through said delivery outlet in a prescribed direction wherein said substrate has a collection outlet at said second location which collects coins that have been returned via said delivery outlet from said escalator; and wherein said dispensing mechanism has a reversible rotation rotary disc opposed to said substrate at a clearance essentially corresponding to the thickness of the coins, guide apertures opened in said rotary disc which guide coins over said substrate, a dispensing arm arranged between said substrate and said rotary disc which dispenses coins along a prescribed path of rotation on said substrate corresponding to the rotation of said rotary disc, and an outlet guide member arranged between said substrate and said rotary disc which makes contact with coins dispensed from said dispensing arm in the case of forward rotation by said rotary disc and guides said coins from said path of rotation to said delivery outlet; wherein, said dispensing arm reverse rotates corresponding to reverse rotation of said rotary disc, receives coins returned from said escalator via said delivery outlet, and dispenses said coins towards said collection outlet along said path of rotation.

5. The coin dispensing apparatus as set forth in claim 4 wherein said coin dispensing apparatus has a collection outlet guide member arranged between said substrate and said rotary disc which makes contact with coins dispensed from said dispensing arm by its reverse rotation and guides said coins from said path of rotation to said collection outlet.

6. The coin dispensing apparatus as set forth in claim 5 wherein said collection outlet guide member has a contact surface which makes contact with coins dispensed from said dispensing arm, and said contact surface is arranged transverse to said path of rotation.

7. The coin dispensing apparatus as set forth in claim 5 wherein said outlet guide member and said collection outlet guide member are provided integrated into a single unit on different sides as reciprocating rotating members.

* * * * *